United States Patent [19]

Kobayakawa et al.

[11] 4,100,456

[45] Jul. 11, 1978

[54] LUMINESCENT DISPLAY PANEL COMPRISING A SEALING MASS FOR ELIMINATING SLOW LEAKS ALONG LEADS

[75] Inventors: Masaki Kobayakawa; Kazufumi Yawata, both of Izumi; Kazuo Ohta; Koichi Kumazawa, both of Mine, all of Japan

[73] Assignees: Nippon Electric Kagoshima, Ltd., Izumi; Narumi China Corp., Nagoya, both of Japan

[21] Appl. No.: 764,648

[22] Filed: Feb. 1, 1977

[30] Foreign Application Priority Data

Feb. 6, 1976 [JP] Japan ..... 51-12641
Feb. 6, 1976 [JP] Japan ..... 51-13427

[51] Int. Cl.[2] ..... H01J 5/24; H01J 5/26; H01J 5/32

[52] U.S. Cl. ..... 313/497; 313/220; 313/513

[58] Field of Search ..... 313/496, 497, 513, 220, 313/188

[56] References Cited

U.S. PATENT DOCUMENTS 3,499,167 3/1970 Baker et al. ..... 313/188 X
4,020,386 4/1977 Yasutome et al. ..... 313/496

*Primary Examiner*—Palmer C. Demeo

[57] ABSTRACT

A luminescent display panel comprises a substrate assembly comprising a solid insulator substrate and an underlying and an overlying insulator layer successively thereon, a glass cover, and a sealing layer sealing the glass cover and the substrate assembly to enclose a vacuum space where electrodes of the panel are placed. Use is made of a sealing mass for positively eliminating slow leak which otherwise occurs if at least one of the leads for the electrodes interposed between the insulator layers is extended outwardly of the vacuum space continuously along the overlying layer. The sealing mass may comprise that portion of the underlying layer which lies across the sealing layer, with all leads laid directly on the solid substrate at their portions extended across the sealing layer. Alternatively, the sealing mass may comprise that extension of the sealing layer which reaches the underlying layer and the above-mentioned at least one lead, with the overlying layer recessed inwardly between the sealing layer and the underlying layer.

11 Claims, 5 Drawing Figures

LUMINESCENT DISPLAY PANEL COMPRISING A SEALING MASS FOR ELIMINATING SLOW LEAKS ALONG LEADS

BACKGROUND OF THE INVENTION

This invention relates to a luminescent display panel, namely, a fluorescent or phosphorescent display panel.

A luminescent display panel comprises a substrate-electrode assembly, a glass cover, and a sealing layer hermetically sealing the substrate-electrode assembly and the glass cover to enclose a vacuum space. The substrate-electrode assembly comprises, in turn, a single solid insulator substrate, a plurality of luminescent anode segments thereon, one or more hot cathodes in the vacuum space over the anode segments, one or more grids between the cathodes and the anode segments, an underlying and an overlying insulator layer successively on the solid substrate exposing the anode segments to the vacuum space, and a plurality of electroconductive leads for electrically connecting the anode segments, cathodes, and grids out from the vacuum space. In a conventional luminescent display panel, at least one of the leads, such as a grid lead, is interposed between the insulator layers and extended outwardly from the vacuum space continuously along the overlying insulator layer as will later be described with reference to one of several figures of the accompanying drawing. On the other hand, it has been found that not a few of the conventional display panels have to be rejected during manufacture because of slow leaks. This has raised the display panel price, despite the fact that conventional luminescent display panels are well designed for mass production using inexpensive materials. Slow leak occur even during operation to render conventional luminescent display panels unreliable.

SUMMARY OF THE INVENTION

It is therefore a general object of the present invention to provide a luminescent display panel which is highly reliable, and which can be manufactured at a low cost.

It is a specific object of this invention to provide a luminescent display panel in which a hermetic seal strongly obviates any slow leaks.

A luminescent display panel to which this invention relates comprises, more particularly, a glass cover comprising a peripheral flange, a substrate-electrode assembly having a pair of principal surfaces and a frame-shaped area along one of the principal surfaces in conformity in shape with the peripheral flange, and a sealing layer substantially between the peripheral flange and the frame-shaped area for hermetically sealing the glass cover and the substrate-electrode assembly to enclose a vacuum space. The frame-shaped area includes at least one strip-shaped area that extends wholly transversely of and partly along the frame-shaped area. The above-mentioned one principal surface comprises a center area surrounded by the frame-shaped area and an edge area outwardly contiguous to the strip-shaped area. The substrate-electrode assembly comprises a single solid insulator substrate having a first and a second surface directed towards the vacuum space and providing the other of the principal surface, respectively, a plurality of luminescent anode segments in juxtaposition on the first surface with the center area, a hot cathode in the vacuum space over the anode segments, at least one grid between the cathode and the anode segments, an underlying and an overlying insulator layer successively on the first surface, and a plurality of electroconductive leads electrically leading the anode segments, cathode, and grid outwardly of the vacuum space along the edge area. The insulator layers expose the anode segments to the vacuum space and have an exposed surface which the above-mentioned one principal surface comprises.

In connection with the display panel of the type described, the fact has now been confirmed that 95% or more of the slow leaks of air surrounding the display panel into the vacuum space occurs through an interface between the overlying insulator layer and at least one of the leads that is interposed between the insulator layers under the center area and extended outwardly of the vacuum space continuously along the overlying insulator layer. In accordance with this invention, a luminescent display panel of the type specified therefore comprises a sealing mass contiguous to the sealing layer for positively eliminating a slow leak which is liable to occur if the display panel would have included the above-mentioned at least one lead.

Figure 1:
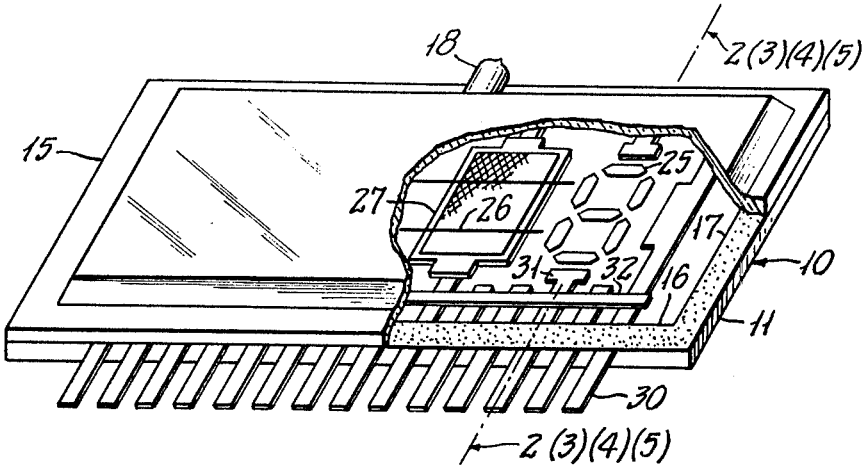
FIG. 1 schematically generally shows a perspective view of a luminescent display panel, with a portion cut away.

DESCRIPTION OF THE PREFERRED EMBODIMENTS:

Referring to FIG. 1, a multi-digit luminescent display panel in general comprises a substrate-electrode assembly 10 having a first and a second principal surface and comprising, in turn, a substrate assembly 11, described below. A glass cover 15 comprises a window portion and a peripheral flange surrounding the window portion. The window portion protrudes from the peripheral flange. For convenience of description of the present invention, it is noted that the first principal surface comprises a frame-shaped area in conformity in shape with the peripheral flange, at least one strip-shaped area 16 that is included in the frame-shaped area and extends wholly transversely and partly along the frame-shaped area, a center area surrounded by the frame-shaped area, and an edge area (not shown in FIG. 1) outwardly contiguous to the strip-shaped area 16. A sealing layer 17, such as a layer of fused frit glass, interposed substantially between the peripheral flange and the frame-shaped area hermetically seals the substrate-electrode assembly 10 and the glass cover 15 to enclose a space, which is evacuated through an exhaust pipe 18 to become a vacuum space. The window portion is juxtaposed with the substrate-electrode assembly center area.

Referring temporarily to FIGS. 2 through 5, the substrate assembly 11 comprises a single solid insulator substrate 20 having a first and a second surface directed towards the first principal surface and providing the second principal surface, respectively, an underlying insulator layer 21 on the first surface, and an overlying insulator layer 22 on the underlying insulator layer 21. The solid insulator substrate 20 is made of an electrically insulating material, such as glass, forsterite, or other ceramics. The insulator layers 21–22 have an exposed surface with the first principal surface comprises. In other words, the first surface may be left partly uncovered by the insulator layers 21–22 to serve as a portion or portions of the first principal surface. In the examples being illustrated, the underlying insulator layer 21 has a marginal area which is outwardly contiguous to the strip-shaped area 16 and which the edge area of the first principal surface comprises.

referring back to FIG. 1, the substrate-electrode assembly 10 further comprises a plurality of luminescent anode segments 25 for a plurality of digits in juxtaposition on the first surface with the center area of the first principal surface, a hot cathode 26 over the anode segments 25 for all digits so as to be placed in the vacuum space, a grid 27 between the cathode 26 and the anode segments 25 for each digit, and a plurality of electroconductive leads 30 electrically connecting the electrodes, namely, the anode segments 25, cathode 26, and grids 27 out of the vacuum space, or along the edge area across the strip-shaped area 16. Each anode segment 25 comprises an underlying segmented anode and an overlying layer of a luminescent material, namely, a fluorescent or a phosphorescent material. The segmented anodes and at least those portions of the leads 30 therefor which are adjacent thereto are formed on the first surface of the solid insulator substrate 20 by firing prints of an electroconductive material, such as silver, silver-palladium, or liquid gold paste. Internal electrode terminals, such as internal grid terminals 31, may also formed on the first surface. The underlying insulator layer 21 is formed on the above-mentioned portions of the leads 30 for the segmented anodes and on the remaining area of the first surface either by fusing prints of frit glass or firing prints of forsterite paste in compliance with the material of the solid insulator substrate 20. Through holes are formed at least at the positions where the luminescent layers are to be subsequently deposited on the respective segmented anodes to complete the anode segments 25. The overlying insulator layer 22 is similarly formed after the leads 30 for the grids 27 are laid on the underlying insulator layer 21. The insulator layers 21–22 are thus for providing electric insulation between the leads 30. The grids 27 may be brought into electrical contact with and fixed to the internal grid terminals 31 by a mass 32 of fused frit glass. Fusing and/or firing may simultaneously be carried out for various parts.

Figure 2:
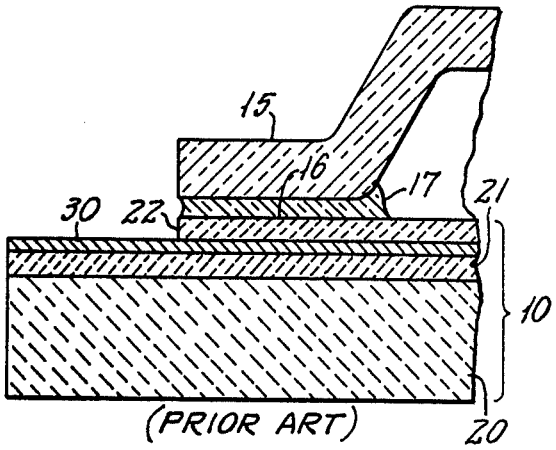
FIG. 2 is an enlarged fragmentary and schematic vertical sectional view of a conventional luminescent display panel, taken on a plane indicated in FIG. 1 by a line 2—2.

Referring more particularly to FIG. 2, a conventional luminescent display panel will be described for a better understanding of the present invention. It is to be pointed out here that the overlying insulator layer 22 extends wholly under the strip-shaped area 16, leaving the edge area of the first principal surface. At least one of the leads 30, such as that for a grid 27, of the conventional display panel is interposed between the underlying and overlying insulator layers 21–22 under the center area and extended outwardly of the vacuum space continuously along the overlying insulator layer 22 and on the underlying insulator layer 21. The leads 30 for the anode segments 25 may be either laid on the first surface or also on the underlying insulator layer 21 at their portions lying along the edge area and inwardly adjacent to the strip-shaped area 16. When laid on the underlying insulator layer 21, the last-mentioned lead portion for the anode segments 25 are electrically connected through additional through holes formed through the underlying insulator layer 21 to the above-described adjacent portions formed directly on the first surface. This applies to the leads 30 for the cathode 26.

As described in the preamble of the instant specification, it has now been confirmed in connection with conventional luminescent display panels of the type described that 95% or more of slow leak occurs through an interface between the overlying insulator layer 22 and at least one of the leads 30. It is believed that this results from inevitable mismatch caused between the overlying insulator layer 22 and the one lead during printing, drying, and fusing or firing thereof. On the other hand, the underlying insulator layer 21 stably adheres to the solid insulator substrate 20 and provides a substantially nonleaking substrate-electrode assembly 10 even through the leads 30 are laid between the solid insulator substrate 20 and the underlying insulator layer 21 from the electrodes 25–27 outwardly of the vacuum space. This applies also to a composite substrate comprising a single solid insulator substrate 20 and a plurality of insulator layers, such as 21–22, successively thereon provided that none of the leads 30 are extended between the insulator layers, such as 21–22, from the electrodes 25–27 outwardly of the vacuum space.

Figure 3:
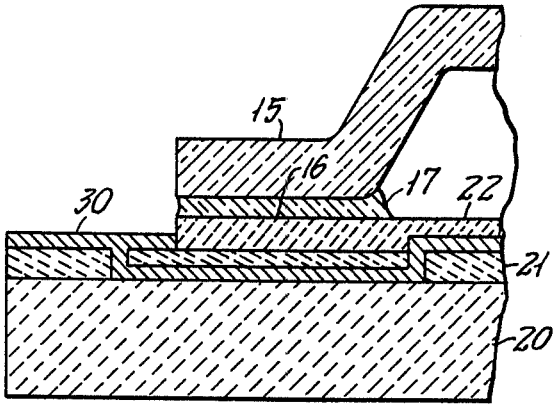
FIG. 3 is an enlarged fragmentary and schematic vertical sectional view of a luminescent display panel according to a first embodiment of the present invention, taken on a plane indicated in FIG. 1 by a line 3—3 coincident with the above-mentioned line 2—2.

Referring now to FIG. 3 more specifically, a luminescent display panel according to a first embodiment of this invention comprises the overlying insulator layer 22 extended throughout under the strip-shaped area 16, leaving the edge area of the first principal surface, as in the above-illustrated conventional display panel. It is to be noted, however, that the leads 30 for all electrodes 25–27 are laid directly on the first surface of the solid insulator substrate 20 at their portions lying across the strip-shaped area 16 and are covered by the underlying insulator layer 21. If any, those portions of the leads 30 which are laid on the underlying insulator layer 21 are electrically connected to the portions lying directly on the first surface through further additional through holes formed, as depicted, through the underlying insulator layer 21. In the illustrated example, the leads 30 lie directly on the first surface also at their portions underlying an inside and an outside area which are inwardly and outwardly contiguous along the first principal surface to the strip-shaped area 16, respectively. That portion of the underlying insulator layer 21 which extends under the outward, strip-shaped, and inward areas serves as a sealing mass for positively eliminating any slow leaks in cooperation with that portion of the overlying insulator layer 22 which extends wholly along the sealing layer 17 and is brought into contact with the corresponding portion of the underlying insulator layer 21 without any intervening leads.

Figure 4:
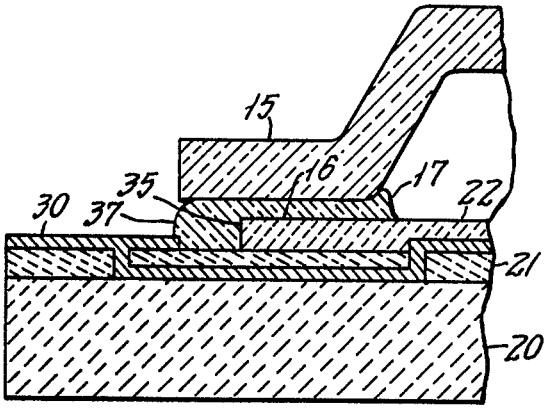
FIG. 4 is a similar view of a luminescent display panel according to a second embodiment of this invention, taken on a plane indicated in FIG. 1 by a line 4—4 coincident with the line 2—2.

Turning to FIG. 4, a luminescent display panel according to a second embodiment of this invention is similar to one according to the first embodiment except that the overlying insulator layer 22 is only partly extended between the sealing layer 17 and the underlying insulator layer 21 to have an edge 35 beneath the sealing layer 17 and to uncover the underlying insulator layer 21 at that outward area portion of the strip-shaped area 16 which is outwardly contiguous to the edge 35. The sealing layer 17 has an extension 37 reaching the outward area portion and covering the edge 35. The sealing mass is herein provided by the above-described portion of the underlying insulator layer 21, that portion of the overlying insulator layer 22 which is interposed between the sealing layer 17 and the underlying insulator layer 21, and the sealing layer extension 37.

Figure 5:
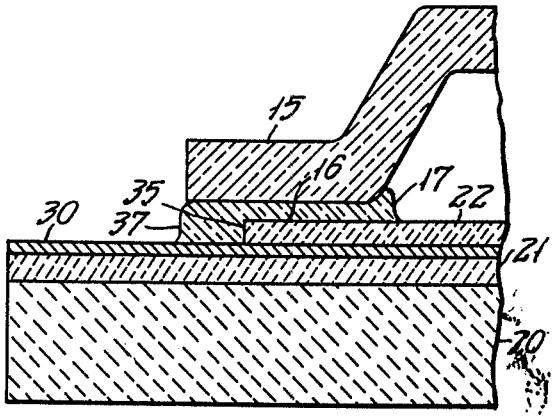
FIG. 5 is a similar view of a luminescent display panel according to a third embodiment of this invention, taken on a plane indicated in FIG. 1 by a line 5—5 again coincident with the line 2—2.

Referring finally to FIG. 5, a luminescent display panel according to a third embodiment of this invention is similar to a conventional luminescent display panel insofar as the arrangement of the leads 30 on the solid insulator substrate 20 and the underlying insulator layer 21 is concerned. The overlying insulator layer 22, however, is recessed inwardly between the sealing layer 17 and the underlying insulator layer 21 on which at least one of the leads 30 is extended from one or more of the electrodes 25–27, such as from a grid 27, outwardly of the vacuum space. More particularly, the overlying insulator layer 22 has at least one edge 35 beneath and in direct contact with the sealing layer 17 so as to uncover the underlying insulator layer 21 at that outward area portion of the strip-shaped area 16 which is outwardly contiguous to the edge 35. The sealing layer 17 has an extension 37 reaching the outward area portion and that portion of the above-mentioned at least one of the leads 30 which is extended along the outward area portion to cover the edge 35 and to hermetically seal the interface betwen the overlying insulator layer 22 and the lead extended from under the center area continuously along the overlying insulator layer 22 but not outwardly of the vacuum space. The sealing mass is herein provided by the sealing layer extension 37. Preferably, the outward area portion, or the sealing layer extension 37, has a width W approximately equal to the thickness of a layer of frit glass preliminarily put on the peripheral flange for the sealing layer 17. The width W, however, is not critical.

It has now been found that the probability of occurrence of the slow leak is reduced to 1/100 or less in a luminescent display panel according to this invention. This raises reliability and yield. Furthermore, a luminescent display panel according to this invention has the same outline and dimensions as a corresponding conventional one. According to the second and third embodiments, it is additionally possible to restrict the sealing layer 17 substantially between the peripheral flange and the strip-shaped area 16 by virtue of the extension 37.

It has been found that this invention manifests its salient feature most remarkably when applied to a luminescent display panel comprising a single solid substrate of unfired forsterite and two or more insulator layers of printed forsterite paste, which substrate and insulator layers are subsequently fired into a substrate assembly 11 with prints of the segmented anodes and leads 30 formed as described hereinabove. This invention is equally well applicable with its astonishing technical merits to a luminescent display panel of any other type. For example, the luminescent display panel may comprise all leads 30 formed directly on the solid insulator substrate 20 along the edge area with the insulator layers 21–22 provided with edges between the edge area and the strip-shaped area 16 and/or within the strip-shaped area 16 rather than at least one of the leads 30, such as a grid lead, extended along the marginal area of the underlying insulator layer 21. The overlying insulator layer 22 may consist of a plurality of constituent insulator layers, as is the case with the underlying insulator layer 21, between which some of the leads 30 may be interposed. Instead of the forsterite paste prints mentioned hereinabove, use may be made of a print or prints of paste of a vitreous material, such as frit glass, for a fired forsterite solid insulator substrate 20.

What is claimed is:

1. A luminescent display panel which comprises a glass cover comprising a peripheral flange, a substrate-electrode assembly having a pair of principal surfaces and a frame-shaped area along one of said principal surfaces in conformity in shape with said peripheral flange, and a sealing layer substantially between said peripheral flange and said frame-shaped area for hermetically sealing said glass cover and said substrate-electrode assembly to enclose a vacuum space, said frame-shaped area including at least one strip-shaped area extending wholly transversely thereof and partly therealong, said one principal surface comprising a center area surrounded by said frame-shaped area and an edge area outwardly contiguous to said strip-shaped area, said substrate-electrode assembly comprising a single solid insulator substrate having a first and a second surface directed towards said vacuum space and providing the other of said principal surfaces, respectively, a plurality of luminescent anode segments in juxtaposition on said first surface with said center area, a hot cathode in said vacuum space over said anode segments, at least one grid between said cathode and said anode segments, an underlying and an overlying insulator layer successively on said first surface, and a plurality of electroconductive leads electrically connecting said anode segments, cathode, and grid out of said vacuum space and extended along said edge area, said insulator layers exposing said anode segments to said vacuum space and having an exposed surface which said one principal surface comprises, wherein the improvement comprises a sealing mass continguous to said sealing layer for positively eliminating the slow leak of air surrounding said display panel into said vacuum space which is otherwise liable to occur if at least one of said leads that is interposed between said underlying and overlying insulator layers under said center area would have been extended outwardly of said vacuum space continuously along said overlying insulator layer.

2. A luminescent display panel which comprises a glass cover comprising a peripheral flange, a substrate-electrode assembly having a pair of principal surfaces and a frame-shaped area along one of said principal surface in conformity in shape with said peripheral flange, and a sealing layer substantially between said peripheral flange and said frame-shaped area for hermetically sealing said glass cover and said substrate-electrode assembly to enclose a vacuum space, said frame-shaped area including at least one strip-shaped area extending wholly transversely thereof and partly therealong, said one principal surface comprising a center area surrounded by said frame-shaped area and an edge area outwardly contiguous to said strip-shaped area, said substrate-electrode assembly comprising a single solid insulator substrate having a first and a second surface directed towards said vacuum space and providing the other of said principal surfaces, respectively, a plurality of luminescent anode segments in juxtaposition on said first surface with said center area, a hot cathode in said vacuum space over said anode segments, at least one grid between said cathode and said anode segments, an underlying and an overlying insulator layer successively on said first surface, and a plurality of electroconductive leads electrically connecting said anode segments, cathode, and grid out of said vacuum space and extended along said edge area, said insulator layers exposing said anode segments to said vacuum space and having an exposed surface which said one principal surface comprises, wherein the improvement comprises a sealing mass contiguous to said sealing layer for positively eliminating the slow leak of air surrounding said display panel into said vacuum space which is otherwise liable to occur if at least one of said leads that is interposed between said underlying and overlying insulator layers under said center area would have been extended outwardly of said vacuum space continuously along said overlying insulator layer, wherein said leads for all of said anode segments, cathode, and grid are laid directly on said first surface at their portions extended across said strip-shaped area, said sealing mass comprising those portions of said underlying and overlying insulator layers which are interposed between said sealing layer and that portion of said first surface which lies under said strip-shaped area.

3. A luminescent display panel which comprises a glass cover comprising a peripheral flange, a substrate-electrode assembly having a pair of principal surfaces and a frame-shaped area along one of said principal surfaces in conformity in shape with said peripheral flange, and a sealing layer substantially between said peripheral flange and said frame-shaped area for hermetically sealing said glass cover and said substrate-electrode assembly to enclose a vacuum space, said frame-shaped area including at least one strip shaped area extending wholly transversely thereof and partly therealong, said one principal surface comprising a center area surrounded by said frame-shaped area and an edge area outwardly contiguous to said strip-shaped area, said substrate-electrode assembly comprising a single solid insulator substrate having a first and a second surface directed towards said vacuum space and providing the other of said principal surfaces, respectively, a plurality of luminescent anode segments in juxtaposition on said first surface with said center area, a hot cathode in said vacuum space over said anode segments, at least one grid between said cathode and said anode segments, an underlying and an overlying insulator layer successively on said first surface, and a plurality of electroconductive leads electrically connecting said anode segments, cathode, and grid out of said vacuum space and extended along said edge area, said insulator layers exposing said anode segments to said vacuum space and having an exposed surface which said one principal surface comprises, wherein the improvement comprises a sealing mass contiguous to said sealing layer for positively eliminating the slow leak of air surrounding said display panel into said vacuum space which is otherwise liable to occur if at least one of said leads that is interposed between said underlying and overlying insulator layers under said center area would have been extended outwardly of said vacuum space continuously along said overlying insulator layer, wherein said leads for all of said anode segments, cathode, and grid are laid directly on said first surface at their portions extended across said strip-shaped area, said overlying insulator layer having at least one edge beneath said sealing layer to uncover said underlying insulator layer at that outward area portion of said strip-shaped area which is outwardly contiguous to said edge, said sealing mass comprising that portion of said underlying insulator layer which extends between said outward area portion and said overlying insulator layer, on the one hand, and that portion of the first surface which lies under said strip-sgaped area, on the other hand, and that extension of said sealing layer which reaches said outward area portion and covers said edge.

4. A luminescent display panel which comprises a glass cover comprising a peripheral flange, a substrate-electrode assembly having a pair of principal surfaces and a frame-shaped area along one of said principal surfaces in conformity in shape with said peripheral flange, and a sealing layer substantially between said peripheral flange and said frame-shaped area for hermetically sealing said glass cover and said substrate-electrode assembly to enclose a vacuum space, said frame-shaped area including at least one strip-shaped area extending wholly transversely thereof and partly therealong, said one principal surface comprising a center area surrounded by said frame-shaped area and an edge area outwardly contiguous to said strip-shaped area, said substrate-electrode assembly comprising a single solid insulator substrate having a first and a second surface directed towards said vacuum space and providing the other of said principal surfaces, respectively, a plurality of luminescent anode segments in juxtaposition on said first surface with said center area, a hot cathode in said vacuum space over said anode segments, at least one grid between said cathode and said anode segments, an underlying and an overlying insulator layer successively on said first surface, and a plurality of electroconductive leads electrically connecting said anode segments, cathode, and grid out of said vacuum space and extended along said edge area, said insulator layers exposing said anode segments to said vacuum space and having an exposed surface which said one principal surface comprises, wherein the improvement comprises a sealing mass contiguous to said sealing layer for positively eliminating the slow leak of air surrounding said display panel into said vacuum space which is otherwise liable to occur if at least one of said leads that is interposed between said underlying and overlying insulator layers under said center area would have been extended outwardly of said vacuum space continuously along said overlying insulator layer, wherein said overlying insulator layer has at least one edge beneath said sealing layer to uncover said underlying insulator layer at that outward area portion of said strip-shaped area which is outwardly contiguous to said edge, at least one of said leads that is interposed between said underlying and overlying insulator layers under said center area being continuously extended along said overlying insulator layer to said edge and further on said underlying insulator layer along said outward area portion outwardly of said vacuum space, said sealing mass comprising that extension of said sealing layer which reaches said outward area portion and covers said edge.

5. In a luminescent display panel which comprises a glass cover comprising a peripheral flange, a substrate-electrode assembly having a pair of principal surfaces and a frame-shaped area along one of said principal surfaces in conformity in shape with said peripheral flange, and a sealing layer substantially between said peripheral flange and said frame-shaped area for hermetically sealing said glass cover and said substrate-electrode assembly to enclose a vacuum space, said frame-shaped area including at least one strip-shaped area extending wholly transversely thereof and partly therealong, said one principal surface comprising a center area surrounded by said frame-shaped area and an edge area outwardly contiguous to said strip-shaped area, said substrate-electrode assembly comprising a single solid insulator substrate having a first and a second surface directed towards said vacuum space and providing the other of said principal surfaces, respectively, a plurality of luminescent anode segments in juxtaposition on said first surface with said center area, a hot cathode in said vacuum space over said anode segments, at least one grid between said cathode and said anode segments, an underlying and an overlying insulator layer successively on said first surface, and a plurality of electroconductive leads electrically leading said anode segments, cathode, and grid outwardly of said vacuum space along said edge area, said insulator layers exposing said anode segments to said vacuum space and having an exposed surface which said one principal surface comprises, the improvement wherein said leads for all of said anode segments, cathode, and grid are laid directly on said first surface at their portions extended across said strip-shaped area, said portions of said leads being covered by said underlying insulator layer, said overlying insulator layer being extended at least partly between said sealing layer and said underlying insulator layer.

6. A luminescent display panel according to claim 5, wherein said leads for all of said anode segments, cathode, and grid are laid directly on said first surface also at their portions extended across an inside and an outside area which lie inwardly and outwardly contiguous, respectively, along said one principal surface to said strip-shaped area, the last-mentioned portions of said leads being covered by said underlying insulator layer.

7. A luminescent display panel according to claim 6, wherein said leads are laid directly on said first surface along said edge area, said underlying and overlying insulator layers exposing said first surface at said edge area.

8. A luminescent display panel according to claim 6, wherein predetermined ones of said leads are laid along that marginal area of said underlying insulator layer which lies outwardly contiguous to said strip-shaped area and which said edge area comprises.

9. A luminescent display panel according to claim 8, wherein said overlying insulator layer is extended wholly between said sealing layer and said underlying insulator layer.

10. A luminescent display panel according to claim 8, wherein said overlying insulator layer is extended only partly between said sealing layer and said underlying insulator layer and has an edge to uncover said underlying insulator layer at that outward area portion of said strip-shaped area which lies outwardly contiguous to said edge, said sealing layer having an extension reaching said outward area portion and covering said edge.

11. In a luminescent display panel which comprises a glass cover comprising a peripheral flange, a substrate-electrode assembly having a pair of principal surfaces and a frame-shaped area along one of said principal surfaces in conformity in shape with said peripheral flange, and a sealing layer substantially between said peripheral flange and said frame-shaped area for hermetically sealing said glass cover and said substrate-electrode assembly to enclose a vacuum space, said frame-shaped area including at least one strip-shaped area extending wholly transversely thereof and partly therealong, said one principal surface comprising a center area surrounded by said frame-shaped area and an edge area outwardly contiguous to said strip-shaped area, said substrate-electrode assembly comprising a single solid insulator substrate having a first and a second surface directed towards said vacuum space and providing the other of said principal surfaces, respectively, a plurality of luminescent anode segments in juxtaposition on said first surface with said center area, a hot cathode in said vacuum space over said anode segments, at least one grid between said cathode and said anode segments, an underlying and an overlying insulator layer successively on said first surface, and a plurality of electroconductive leads electrically leading said anode segments, cathode, and grid outwardly of said vacuum space along said edge area, said insulator layers exposing said anode segments to said vacuum space and having an exposed surface which said one principal surface comprises, the improvement wherein said overlying insulator layer is extended only partly between said sealing layer and said underlying insulator layer to have an edge beneath said sealing layer and to uncover said underlying insulator layer at that outward area portion of said strip-shaped area which is outwardly contiguous to said edge, at least one of said leads that is interposed between said underlying and overlying insulator layers under said center area being extended continuously along said overlying insulator layer to said edge and further on said underlying insulator layer along said outward area portion outwardly of said vacuum space, said sealing layer having an extension reaching said outward area portion and covering said edge.

* * * * *